US006462658B1

(12) United States Patent
Bender

(10) Patent No.: US 6,462,658 B1
(45) **Date of Patent: *Oct. 8, 2002**

(54) OBJECT LOCATOR AND PROTECTION SYSTEM

(76) Inventor: Sheldon Bender, 5123 Northwest 24th Way, Boca Raton, FL (US) 33496

( * ) Notice: Subject to any disclaimer, the term of this patent is extended or adjusted under 35 U.S.C. 154(b) by 0 days.

This patent is subject to a terminal disclaimer.

(21) Appl. No.: 09/711,729

(22) Filed: Nov. 13, 2000

(51) Int. Cl.[7] ..... G08B 13/14

(52) U.S. Cl. ..... 340/568.1; 340/539; 340/571; 340/825.42; 340/825.49

(58) Field of Search ..... 340/539, 568.1, 340/568.6, 571, 825.24, 825.49, 815.42

(56) References Cited

U.S. PATENT DOCUMENTS

| | | | | | |
|---|---|---|---|---|---|
| 3,665,313 | A | | 5/1972 | Trent | 325/55 |
| 4,101,873 | A | | 7/1978 | Anderson et al. | 340/539 |
| 4,476,469 | A | | 10/1984 | Lander | 340/825.49 |
| 4,598,272 | A | * | 7/1986 | Cox | 340/539 |
| 4,814,742 | A | | 3/1989 | Morita et al. | 340/825 |
| 4,871,997 | A | * | 10/1989 | Adriaenssens et al. | 340/539 |
| 5,043,702 | A | | 8/1991 | Kuo | 340/539 |
| 5,087,906 | A | | 2/1992 | Eaton et al. | 340/815.42 |
| 5,126,719 | A | | 6/1992 | Desorbo | 340/571 |
| 5,223,815 | A | * | 6/1993 | Rosenthal et al. | 340/539 |
| 5,278,556 | A | | 1/1994 | Oh | 340/988 |
| 5,396,218 | A | * | 3/1995 | Olah | 340/568.1 |
| 5,402,104 | A | * | 3/1995 | LaRosa | 340/568.1 |
| 5,576,692 | A | | 11/1996 | Tompkins et al. | 340/571 |
| 5,598,143 | A | | 1/1997 | Wentz | 340/539 |
| 5,629,677 | A | | 5/1997 | Staino, Jr. | 340/568 |
| 5,638,050 | A | | 6/1997 | Sacca et al. | 340/571 |
| 5,673,023 | A | | 9/1997 | Smith | 340/825 |
| 5,677,673 | A | | 10/1997 | Kipnis | 340/539 |
| 5,680,105 | A | | 10/1997 | Hedrick | 340/571 |
| 5,686,891 | A | | 11/1997 | Sacca et al. | 340/571 |
| 5,790,021 | A | | 8/1998 | Mickel et al. | 340/825.49 |
| 5,835,013 | A | * | 11/1998 | Duterte | 340/571 |
| 5,949,328 | A | | 9/1999 | Latty | 340/539 |
| 5,952,918 | A | | 9/1999 | Ohayon | 340/571 |
| 6,147,602 | A | * | 11/2000 | Bender | 340/568.1 |

* cited by examiner

*Primary Examiner*—Daniel J. Wu
(74) *Attorney, Agent, or Firm*—Ostrager Chong & Flaherty LLP

(57) ABSTRACT

An object locator system includes a transmitter unit which sends one of a plurality of RF signals upon actuating a first pushbutton, and a receiver unit attached to or incorporated into an object for detecting the RF signals and illuminating a light element and/or activating a sound speaker in response to the detected RF signal. The user may program the receiver unit by using the transmitter unit to select a specific melody or song stored in the receiver unit. The transmitter unit may be used at one time with a plurality of receiver units by programming the transmitter unit to send a unique coded signal corresponding to each receiver unit. The object locator system may also be set in a protection mode which continuously transmits an RF signal but activates the light element and/or the sound speaker only when the receiver unit no longer detects the RF signal.

22 Claims, 7 Drawing Sheets

FIG. 2A
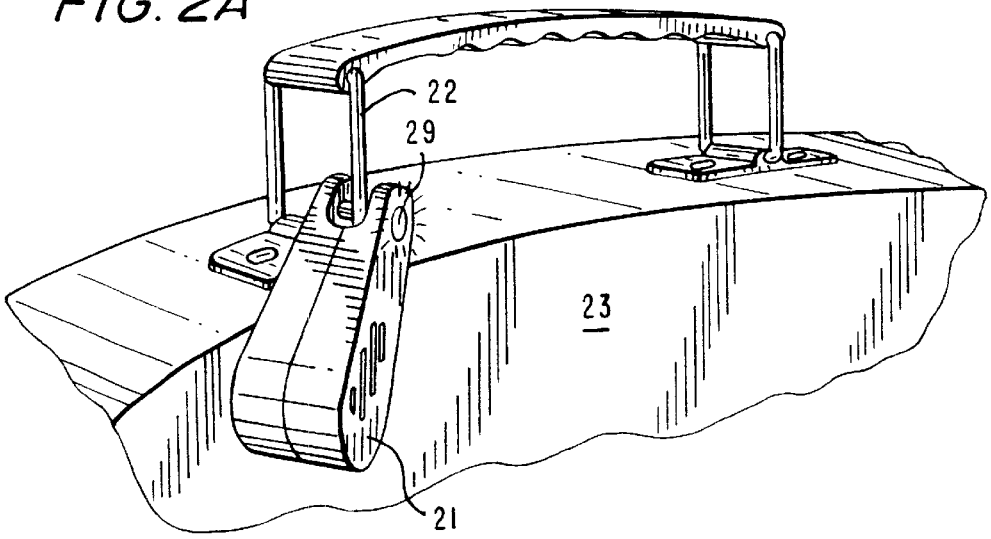
FIG. 2B
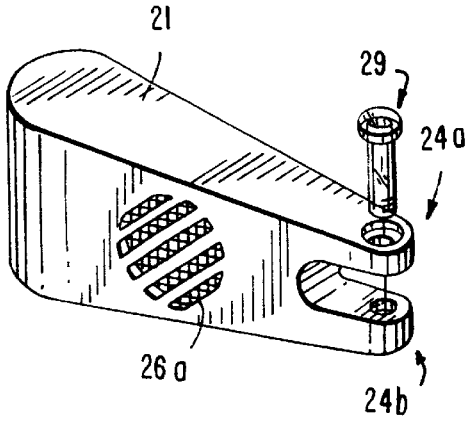
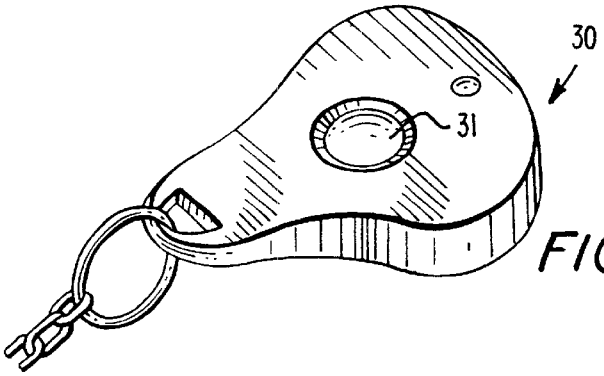
FIG. 4

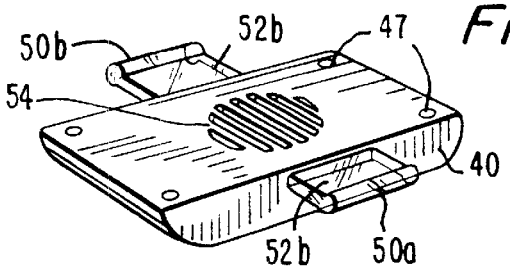
FIG. 3A
FIG. 3B
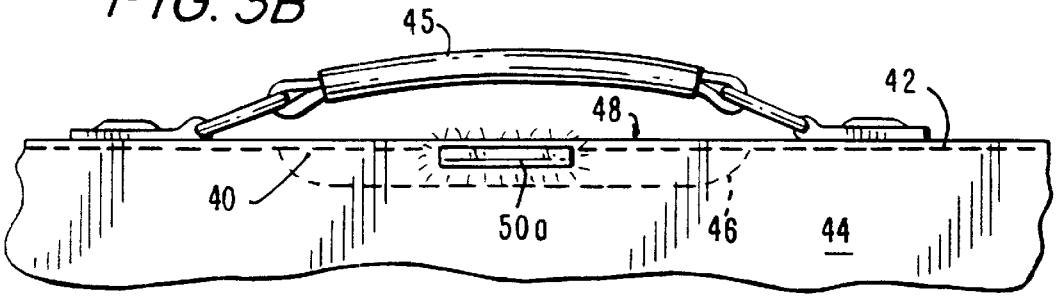
FIG. 3C
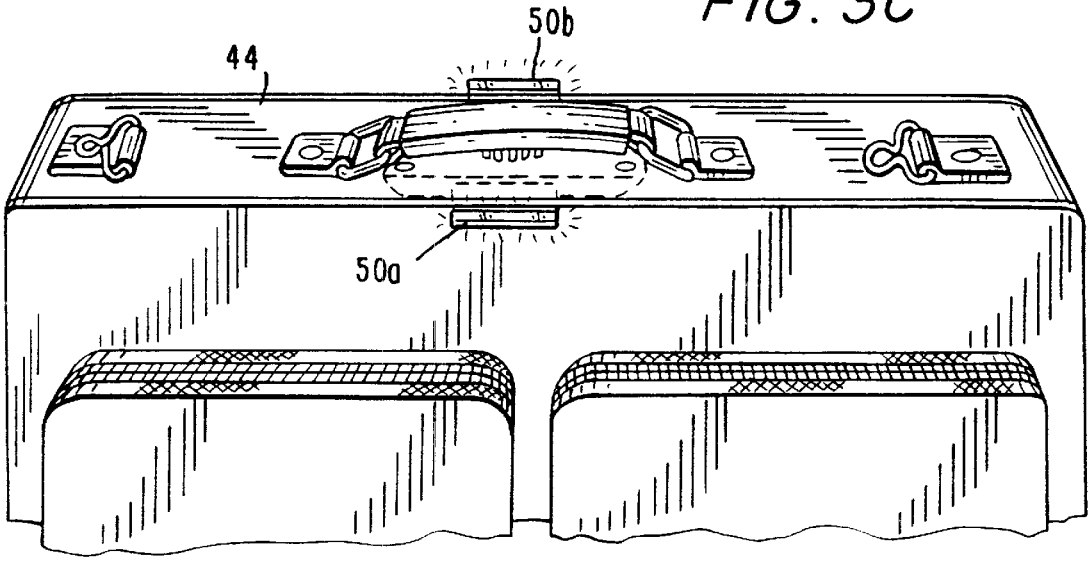

OBJECT LOCATOR AND PROTECTION SYSTEM

FIELD OF INVENTION

This invention relates generally to a system for locating missing items and for protecting the items once located. More particularly, the invention relates to an apparatus and method for identifying the location of a missing item including a transmitter and receiver which employ electronic circuitry.

BACKGROUND OF THE INVENTION

This invention was conceived to solve a common problem experienced by travelers, namely, to have some means for identifying or locating their luggage in a baggage claim area of an airport, bus terminal or the like, and for ensuring that their luggage is not lost or stolen after it is retrieved. Luggage is often confused with similar looking luggage or mistakenly removed from the baggage claim area and moved to another location. It is therefore typical in airports for travelers to have difficulty identifying or finding their luggage and keeping their luggage close to them while retrieving other pieces of luggage. Of course, these types of problems exist with many other objects as well. It would thus be useful to have a means for identifying or locating a plurality of items in any location.

It is well known to use a miniaturized signal transmitter to activate a battery powered receiver for the purpose of locating a wide range of objects such as automobiles, e.g., U.S. Pat. No. 5,278,556 to Oh, television remote controls, U.S. Pat. No. 5,598,143 to Wentz, U.S. Pat. No. 5,638,050 to Sacca, and U.S. Pat. No. 5,686,891 to Sacca, eyeglasses, U.S. Pat. No. 5,629,677 to Staino, Jr., and other items which are commonly misplaced, U.S. Pat. No. 5,677,673 to Kipnis. Radio frequency transmitters and receivers which emit both light and sound are also commonly used for purposes of locating lost objects, e.g., U.S. Pat. No. 4,101,873 to Anderson, U.S. Pat. No. 4,476,469 to Lander, and U.S. Pat. No. 5,680,105 to Hedrick.

It is also known in the art to apply such radio transmitting technology to luggage. U.S. Pat. No. 5,126,719 to DeSorbo discloses a remotely armed suitcase alarm system. The system comprises a remote transmitter unit and a motion sensitive alarm which is attached to the suitcase and includes a signal receiver unit. U.S. Pat. No. 5,043,702 to Kuo discloses an alarm/security device integrated in the luggage which can be remotely activated to produce a siren and an electric shock. U.S. Pat. No. 5,576,692 to Tompkins discloses an airport luggage tracking system which utilizes a beeper paging device and requires a telephone call through a nationwide paging system to locate the luggage.

The prior art devices attempt to solve the same general problem of locating objects by a signal-activated receiver or an alarm transmitter attached to the object. However, each has a problem in utilization which makes it relatively unattractive to manufacture or use. Some devices incorporate costly timer shutoff or battery power saver circuitry in an attempt to conserve power usage and prolong the use time between battery changes. To attract the user' attention, others require a loud alarm or distinctly audible type of sound, such as a loud continuous beeping, which may be annoying or disturbing to other people in the vicinity. Other devices employ complex triangulation locator circuitry in order to allow a person distant from the object to home in on the object. Still others employ cumbersome encoding circuitry and activation elements to initialize individual devices for a plurality of objects that might be lost.

Accordingly, it is a broad object of this invention to provide an improved locator device for identifying and locating an object which is inexpensive to produce and operates in a manner that allows the user to find the tagged object easily. In particular, it is desired that costly timer shutoff or battery power saver circuitry, loud annoying sounds, triangulation locator circuitry, or cumbersome encoding elements are avoided.

It is a further object of this invention to provide a small transmitting device activated by the push of a button which signals a receiving device attached to or incorporated into any item to send out an easily identifiable audible and/or visible signal.

A still further object of this invention is to provide an improved locator device having a user selected setting on the transmitting device that allows the user to identify when an item containing the signal receiving device is moved more than a specified distance away from the user.

SUMMARY OF THE INVENTION

In the present invention, these purposes as well as others which will be apparent are achieved generally by providing an inexpensive and easy to use electronic system for locating an object from a remote location.

In accordance with the present invention, an object locator system comprises: at least one transmitter unit having a casing housing a transmitter circuit therein for outputting an RF signal, a first pushbutton operable externally of the casing and coupled to the transmitter circuit for sending the RF signal only when the pushbutton is pressed, a second pushbutton for use in programming the certain features of the locator system, and a slide switch for determining an operating mode (i.e., on/off/protection); and at least one receiver unit having a casing provided with attachment means for allowing it to be attached to or incorporated into an object, said casing housing a receiver circuit for receiving the RF signal transmitted by the transmitter unit and outputting an activation signal, and a light illumination element that is illuminated in response to the activation signal, wherein said receiver circuit is operative to output said activation signal only for so long as the RF signal is received from the transmitter unit.

The transmitter circuit includes a digital oscillator and a user operated means for setting the transmitter circuit to send at least one unique coded signal, and the receiver circuit includes a digital decoder circuit and a user operated means for setting the receiver circuit to detect the unique coded signal, whereby the receiver unit only responds to the transmitter unit sending the unique coded signal. In a preferred embodiment, the transmitter unit may be programmed to send several unique coded signals for operating a plurality of receiver units. The unique coded signal may be set in the transmitter and receiver circuits either during manufacture or by the user by means of a digital processor, which enables a broader range of coded signals.

The receiver casing may be formed with an through-hole at a narrowed end, through which a fastener is inserted for attaching the receiver unit to a selected object. Alternatively, the light illumination element and attachment means may be combined in one element or the receiver casing may be incorporated directly into the selected object. The transmitter unit is formed as a small hand held unit about the size of a key ring. The receiver unit includes a sound generator for generating a sound output in response to the activation signal in cases where the object is out of the user's visual field or hidden from view. The invention also encompasses the related method of sending the RF signal and illuminating the light element only for so long as the RF signal is received from the transmitter unit, in order to provide the user direct visual feedback to the user's pushbutton presses that would make it easy to locate the object in a crowded visual field.

In the preferred embodiment, the transmitter unit can be placed in a protection mode by moving the slide switch or alternatively, the transmitter may be programmed by the user to transmit an RF signal or series of RF signals to the receiver unit to activate the protection mode. In this mode, the object must be within a specified distance of the user (and the transmitter) and if the object is moved out of that distance, the receiver unit will emit the selected sound and/or light. To achieve this, the locating circuitry is reversed. The transmitter unit continuously sends the coded signal specified for a selected receiver unit, as opposed to only when the pushbutton is pressed. The receiver unit therefore continuously receives the coded signal and will generate a sound and/or light output when the coded signal is no longer received.

DESCRIPTION OF THE DRAWINGS

FIGS. 2A and 2B illustrate another embodiment of the receiver unit.

FIGS. 3A, 3B and 3C illustrate a further embodiment of the receiver unit incorporated into a piece of luggage.

FIG. 4 illustrates an embodiment of a transmitter unit.

DETAILED DESCRIPTION OF THE INVENTION

The object locator system of the present invention is comprised of two units, a transmitter unit that emits an activation signal when a pushbutton is actuated, and a receiver unit that is attached to an object, such as by a chain or loop fastener, or incorporated directly into the object, which has a light pipe visual indicator that is illuminated in response to receipt of the activation signal. The light pipe provides a flash of illumination each time the user actuates the transmitter, and therefore provides direct visual feedback with each button press by the user. This direct feedback ensures that the user can pick out the light flash in a crowd without the need for a loud alarm or continuous annoying beeping or a triangulation locator device.

Preferably, the light pipe is provided with a length running at least partially around the perimeter of the receiver unit so that it is more visually prominent and can be seen at all angles from the user. The light pipe's length and location may, of course, be altered to present a different market appearance or to allow for different engineering specifications. A digital oscillator circuit with dip switch settings may be used for setting a unique coded signal to be sent by the transmitter, and the receiver circuit may be set in similar fashion with dip switch settings to detect the encoded signal. Alternatively, the transmitter and receiver may be pre-coded with unique signals during manufacture or, in the case where more than one receiver is to be used with each transmitter, the transmitter and receiver may be programmed by the user. In these manners, the receiver only responds to its associated transmitter, and each transmitter/receiver pair can be initialized for any one of a plurality of different objects to be located. Each transmitter may also be programmed by the user to send a coded signal to more than one receiver.

Figure 1A:
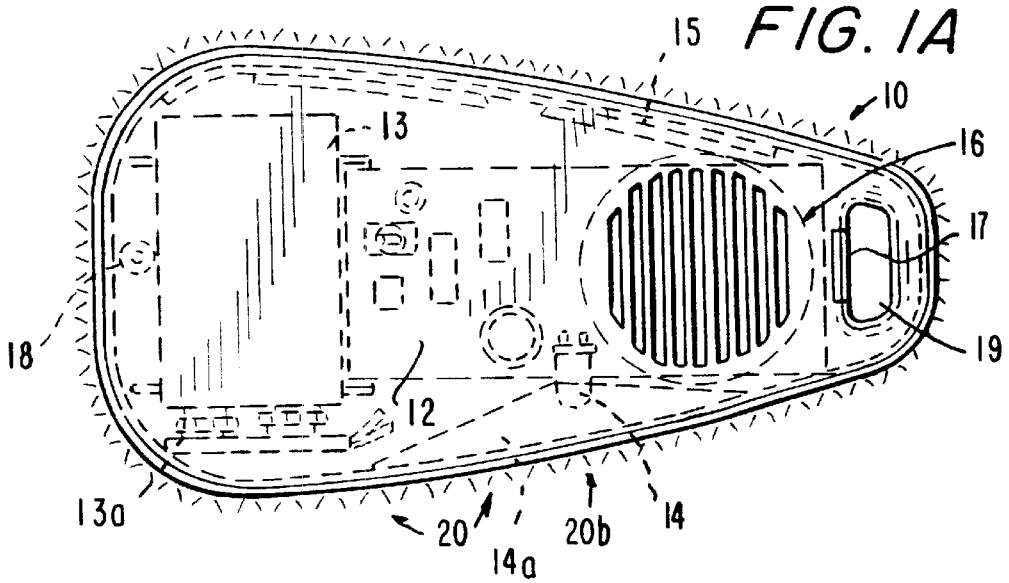
FIGS. 1A, 1B, and 1C are plan, side, and perspective views of a preferred embodiment of a receiver unit in accordance with the present invention.
Figure 1B:
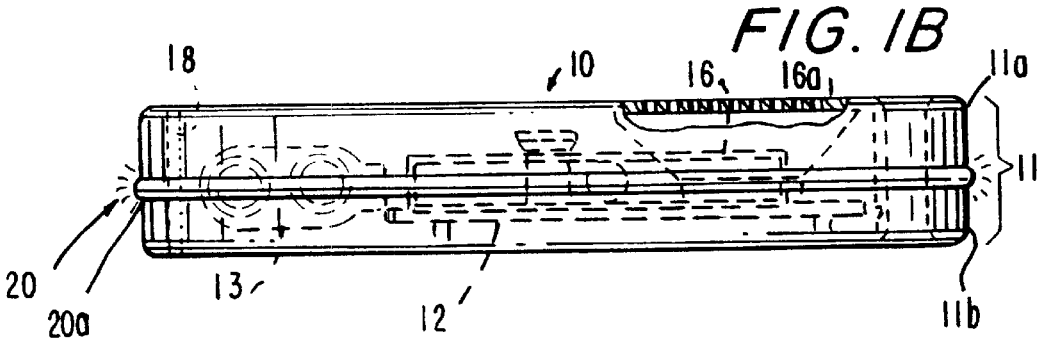
Figure 1C:
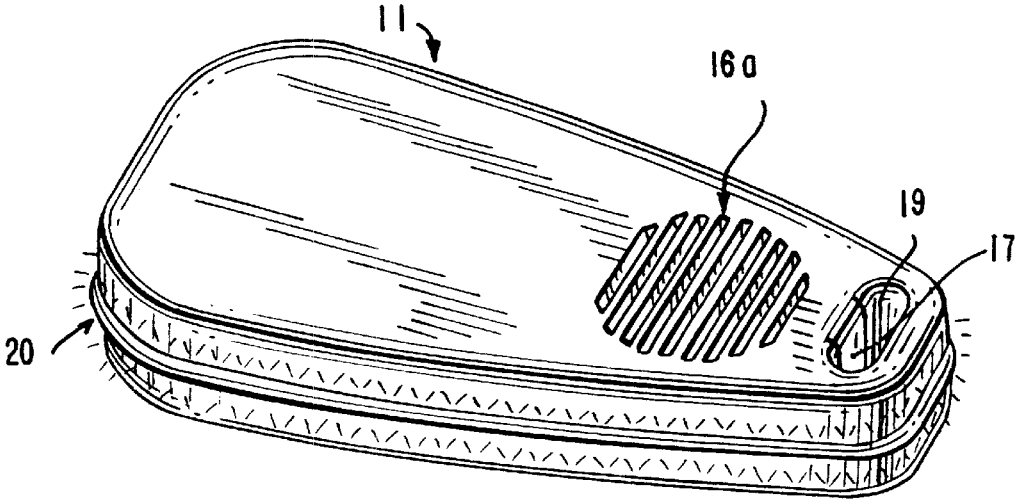

In FIGS. 1A, 1B, and 1C, the receiver unit 10 is shown having a casing 11 with complementary halves 11*a,* 11*b* enclosing a circuit board 12 mounting the circuitry for the receiver functions, a battery 13, battery connectors 13*a,* a light emitting diode (LED) 14 and head reflector 14*a,* an antenna 15, and a speaker 16 behind a grill 16*a*. The two halves of the casing are attached by a latch or hold down 17 on one end, and a screw fastener 18 on its opposite end. The screw fastener 18 can be removed to allow access into the casing for setting dip switch settings therein, such as for setting the receiver to detect an encoded signal or to select a sound output type (described further herein). The casing can be made of a hard plastic material, such as LEXAN (TM), and molded with a clamshell or ovoid shape to provide a narrowed end by which it is attached to an object such as the handle of luggage. The casing is formed with an through-hole or aperture 19 at its narrowed end, through which a chain, plastic loop, or other type of secure fastener is inserted for attaching the receiver unit to a piece of luggage or other object.

A light illumination element 20 is mounted to or on an external surface of the casing so that it is visible to the user. Preferably, the element is a light pipe which has a length running at least partially around the perimeter of the receiver unit, and most preferably running along three sides of the receiver unit. The light pipe is fabricated as a tubular length of light transmissive plastic having an internal index of refraction which results in light rays at low angles of incidence being reflected down the pipe and light at high angles of incidence being transmitted through the pipe walls as external illumination. The light pipe may have tiny reflective particles or a dispersion of bubbles or other reflective elements embedded therein to promote the even dispersion of light along the length of the pipe. The light pipe 20 is retained in a recess 20*a* formed by an indentation in the facing walls of the casing halves 11*a,* 11*b*. A head end 20*b* of the light pipe 20 is fixed inside the casing 11 facing the LED 14 and reflector 14*a,* so that light from the LED 14 is directed into and transmitted down the light pipe. Preferred LEDs have a rated life expectancy of approximately 50 hours and a power rating of 3.6–4.0 VDC. To provide greater illumination, multiple LEDS may be used to direct light into the light pipe.

In FIGS. 2A and 2B, another version of the receiver unit has a casing 21 enclosing similar elements as described above for the first embodiment. In this version, the receiver is attached directly to a handle post 22 of a piece of luggage 23 by a threaded post 29 made of light transmissive plastic material as in the light pipe of the first embodiment. The plastic post 29 is insertable through a hole in one flange 24*a* of the casing 21 and secured by threading into a fastener hole in another flange 24*b* of the casing. In the secured position, the end of the post 29 is positioned adjacent an LED inside the casing, as described above, for directing light into the post. Thus, the illumination element and fastener to the object are combined in one element.

In FIGS. 3A, 3B and 3C, a further version of the receiver unit has a casing 40 enclosing similar elements as described above for the first embodiment. In this version, the receiver is incorporated directly into a side panel 42 of a piece of luggage 44 during manufacture of the luggage, preferably near the handle 45 of the luggage. The casing 40 is mounted between an inner supporting wall 46 and an outer covering 48 of the top side panel 42 and secured by inserting screws, rivets or the like through the outer covering and into the holes 47 provided in the casing. In this manner, the receiver unit may be incorporated into both hard and soft cover luggage. The casing 40 includes two flanges 52*a,* 52*b* which extend out of opposing sides of the casing and have portions 50*a,* 50*b* made of light transmissive plastic material as in the light pipe of the first embodiment. The flanges 52*a,* 52*b* are adjustable to extend the width of the luggage, such that each light pipe is visible on opposing sides of the luggage. Alternatively, the light pipes 50*a,* 50*b* may be located on a top surface of each flange 52*a,* 52*b* and may extend through apertures cut into the outer covering 48. Each flange 52*a,* 52*b* is positioned adjacent an LED inside the casing, as described above, for directing light into the flange and toward the light pipes 50*a,* 50*b.* Thus, this embodiment may utilize two LEDs. A sound producing device is also mounted in the casing behind a grill 54.

As shown in FIG. 4, the transmitter is a small hand held unit 30 about the size of a key ring which can be easily carried by the owner and/or unobtrusively attached to a variety of objects such as a key ring. The transmitter casing encloses transmitter circuitry, a battery power source, and an antenna, in a similar manner as described for the receiver unit. The casing can be opened to allow access for setting dip switch settings therein, such as for setting the transmitter to send a particular encoded signal (described further herein). An activation button 31 is mounted on an external side of the casing for convenient operation by the user. Activation of the transmitter results in sending an encoded radio frequency (RF) signal. The RF signal for the indicated size and battery capacity of the transmitter typically would have an effective range of about 50–100 feet. The transmitter may also include an LED which is illuminated upon activation of the transmitter, to confirm to the user that the transmitter is functioning properly.

Figure 7A:
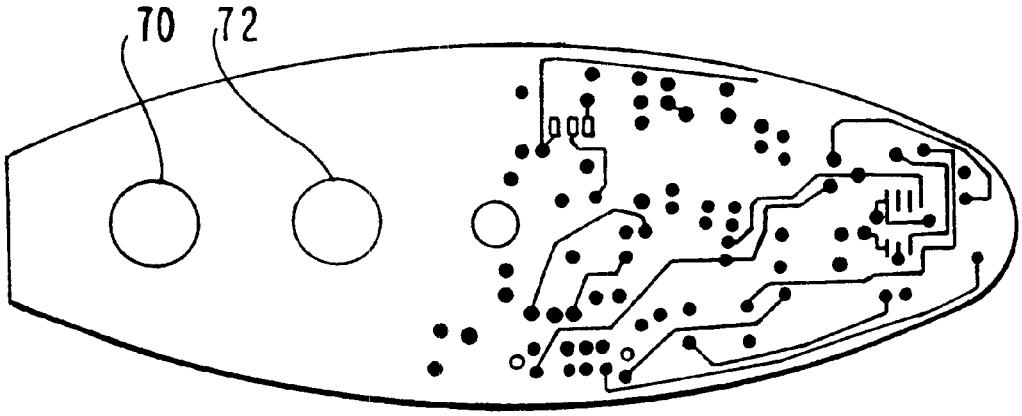
FIGS. 7A and 7B are diagrams of an example of a transmitter circuit board layout in accordance with a digital embodiment of the invention.
Figure 7B:
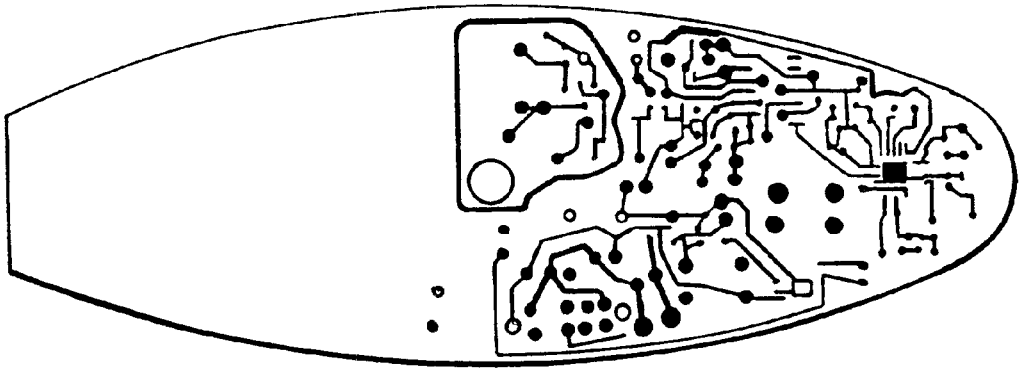

A further embodiment of the transmitter unit's circuitry is shown in FIGS. 7A and 7B. This is a digital circuit having two activation buttons 70 and 72 mounted on an external side of the casing for convenient operation by the user. Activation of one of the activation buttons results in sending an encoded radio frequency (RF) signal. The other activation button is used for programming the transmitter to select a signal corresponding to a specified receiver unit and for programming the receiver to play one of several different response sounds, for example, melodies or songs.

A unique aspect of the present invention is the activation of the receiver, upon receipt of a signal from the transmitter, to emit light through the light pipe in response to the user depressing the activation button on the transmitter. The user can thus activate a series of light flashes of arbitrary duration by depressing the transmitter button on and off at will. When the user scans an area where the object might be found, the visual perception of light flashes being emitted in direct response to the user's button presses provides a direct visual feedback to the user that makes it easy to pick out the flashes in a crowded visual field, and thereby locate the object. This direct feedback makes it unnecessary to have the receiver emit a loud or distinctly audible sound that would annoy other persons.

The embodiments described herein are also provided with a sound speaker or piezzo-electric sound element that is operated at lower audible levels that would be tolerable to passers-by, such as a warbling or chirping sound. The sound output can assist the user in the event the object is located nearby but out of the user's visual field, such as behind the user or in a compartment or area shielded from the user's sight. In a preferred embodiment of the invention, a user will be able to choose from one of eight melodies to be played upon activation by the transmitter. Using the second transmitter activation button, a user can send a programming signal to the receiver unit for selecting a desired sound output.

By activating the receiver to emit light only when the transmitter signal is sent, and with low speaker levels, the system of the present invention also conserves the receiver's battery power without the need for complicated power shutoff or timer circuitry. The light pipe also provides an aesthetic element to the locator device that would make it more attractive to users.

Figure 5:
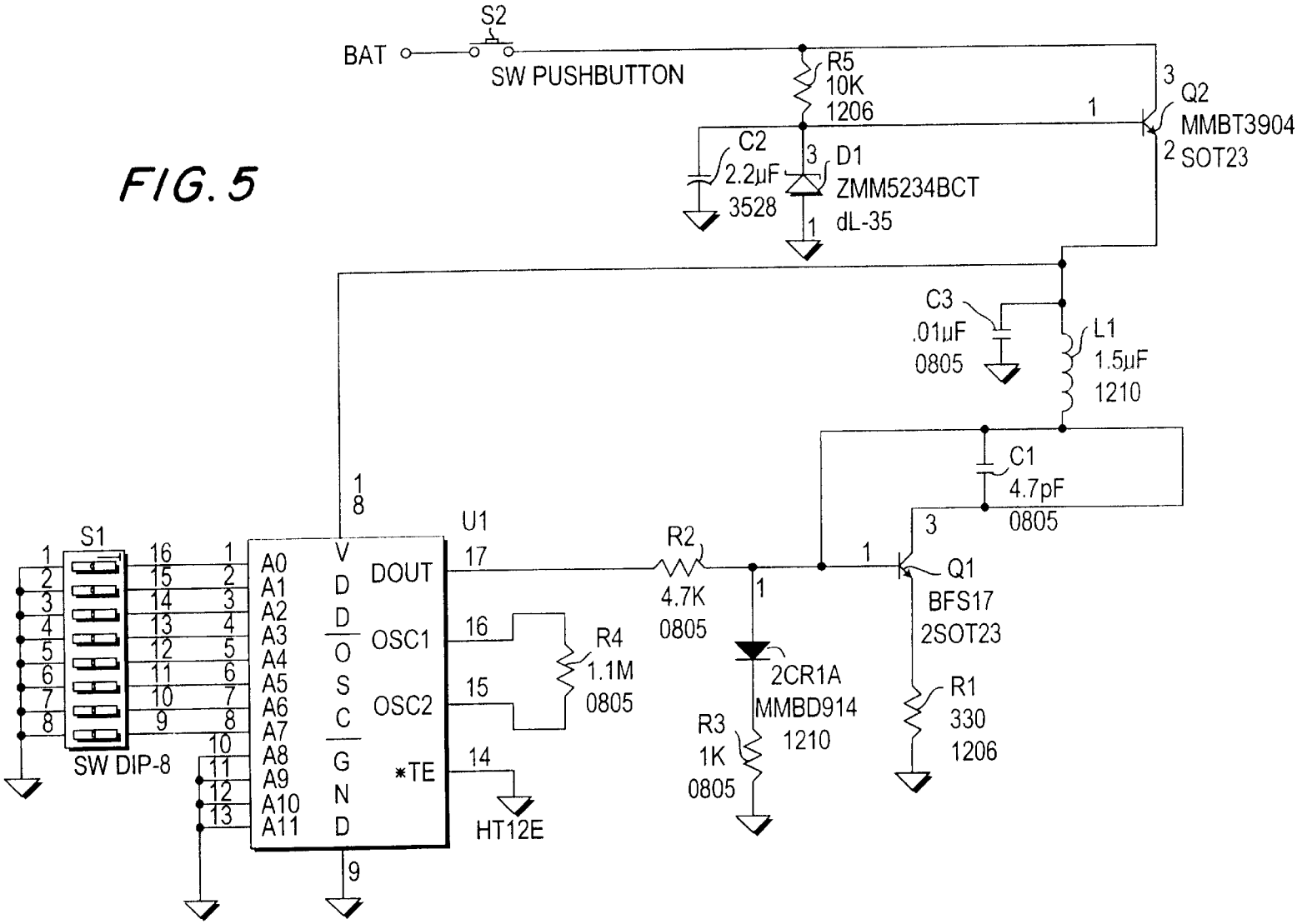
FIG. 5 is a diagram of an example of a transmitter circuit for the transmitter in accordance with an analog embodiment of the invention.

In FIG. 5, an example of a circuit for the transmitter is shown having a battery input BAT, a pushbutton switch S2, a driver transistor Q3, a digital oscillator unit OSC, an array of dip switch S1, and an RF output circuit including an inductor element L1. The array of dip switches S1 has 8 bit positions for setting a unique binary number to be coded with the transmitted signal. In this manner, the transmitter is set to locate only the object that has a receiver set to detect the encoded signal. An array of 8 dip switches provides capability of setting up to 256 unique coded signals. The battery may be a 12 V battery with a service life of 2000 hours (about 3 months) in stand by mode or, in the digital circuit of FIGS. 7A and 7B may be two button type batteries, which enables the units to be made smaller. The RF circuit generates an RF signal at 315 MHz and at a power level sufficient for a typical 50–100 foot range for locating an object. The digital oscillator can be a unit such as one manufactured under the part number HT12E by Holtek Corp.

Figure 6A:
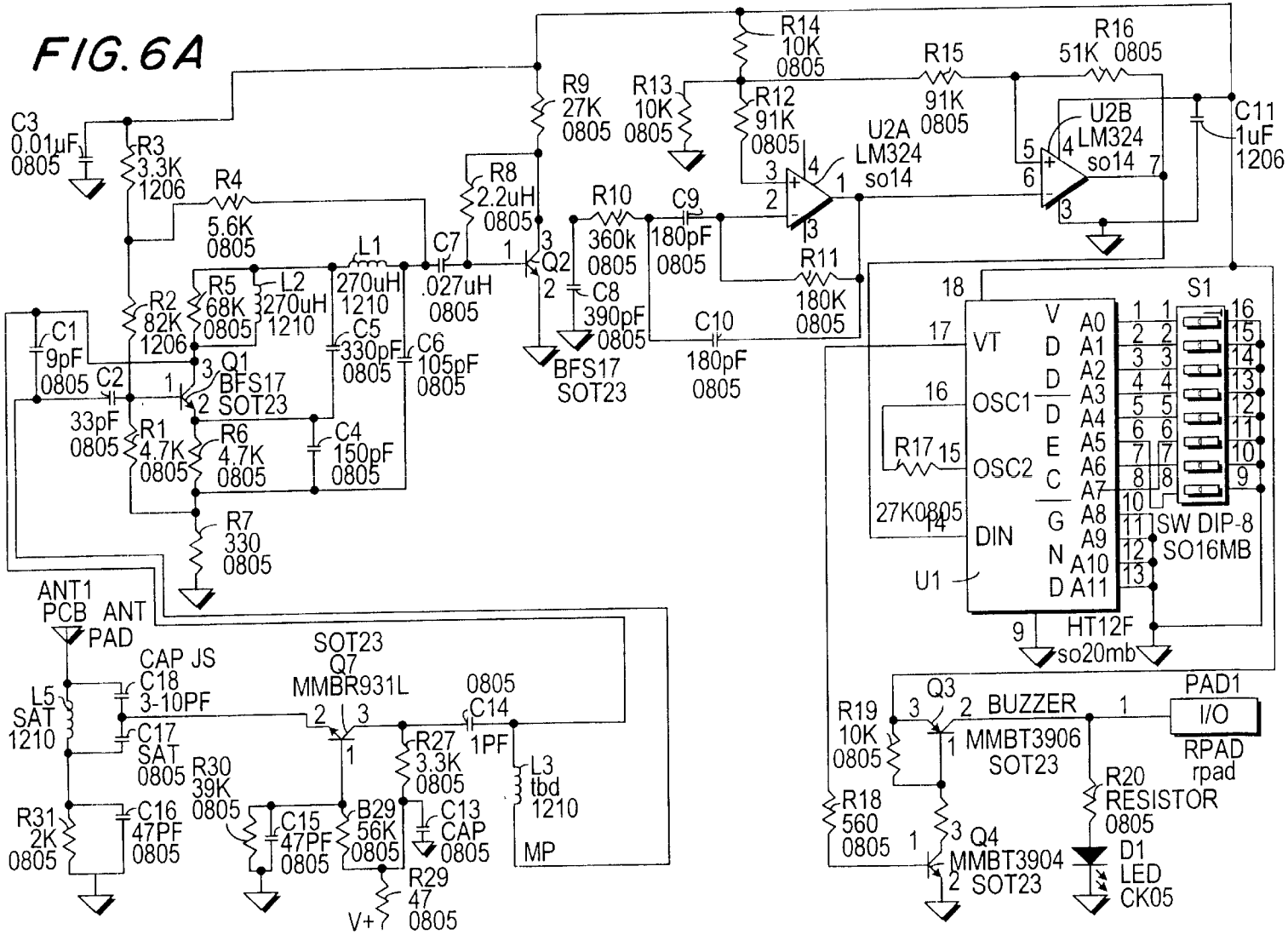
FIGS. 6A and 6B are diagrams of an example of a receiver circuit for the receiver unit for use with the transmitter circuit shown in FIG. 5.

In FIG. 6A, an example of a circuit for the receiver is shown having an antenna circuit including an antenna element ANT1, a signal passing circuit including transistor Q7, an analog-to-digital conversion circuit including multivibrators U2A and U2B, a digital decoder unit DEC, an array of dip switches S1, and a light emitting diode LED. The array of dip switches S1 has 8 bit positions for setting the unique binary number matched to that coded in the transmitter for detecting of the transmitted signal intended for that receiver. The battery power supply for the receiver can be a 9 V battery with a service life of 2000 hours (about 3 months) in stand by mode or may be two button type batteries. The digital decoder can be a unit such as one manufactured under the part number HT12F by Holtek Corp.

Figure 6B:
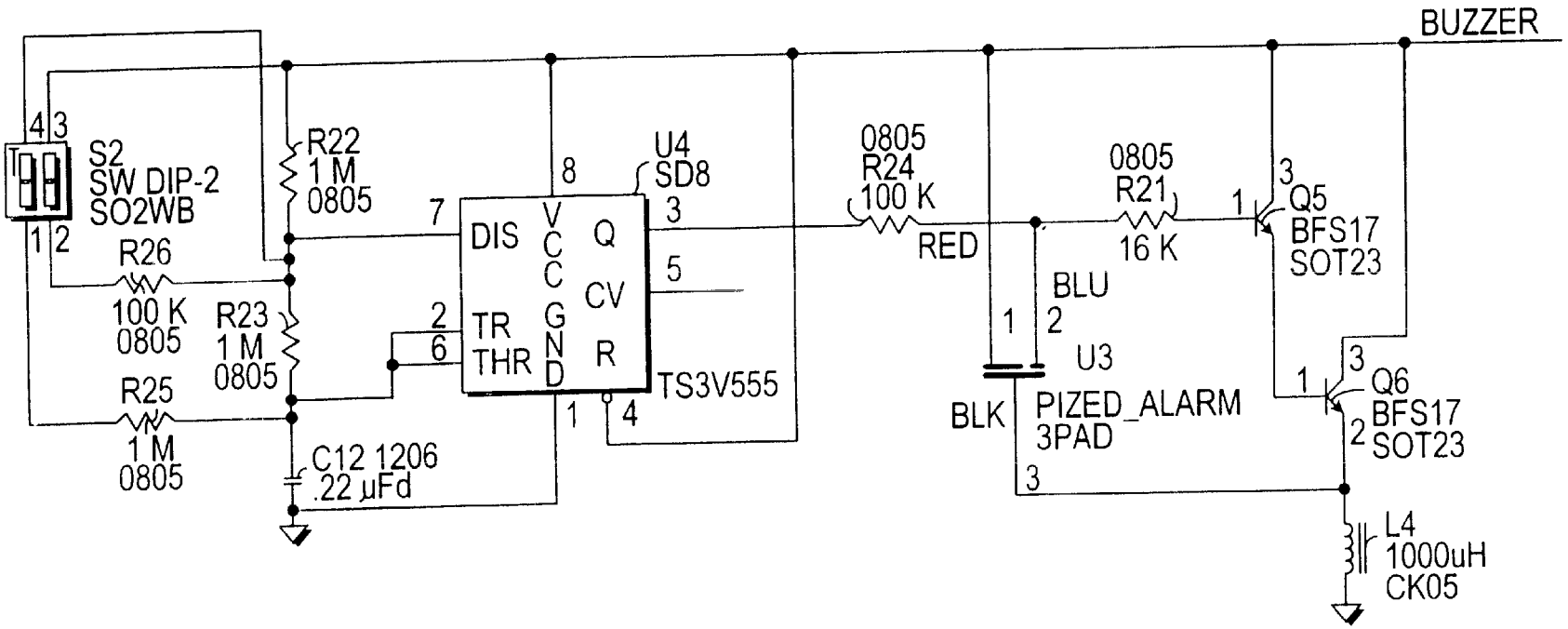

In FIG. 6B, an example of a sound generator circuit for the receiver is shown having a buzzer input BUZZER (from an output of the digital decoder unit, a switch S2, a digital sound signal generator unit U4, and a piezoelectric sound element U3. The switch S2 is set to select from up to four types of sound output signals. The digital sound signal generator can be a unit such as one manufactured under the part number TS3V555 by Motorola Corp. Alternatively, a sound speaker unit may be used to provide a broader sound range.

It will be recognized by those skilled in the art that the locator system of the invention has wide application for use in identifying and locating missing objects, and that numerous modifications are possible in light of the above disclosure. For example, the size, shape and color of the transmitter and receiver units, as well as the size, shape, color and location of the light pipe, may be modified in any number of ways to present a different marketing presentation or to accommodate different engineering specifications. Further, other types of signal transmission may be used, such as infrared, sonic and ultrasonic, and any known electronic circuit designs may be used for generating, transmitting and receiving such signals. Numerous other modifications and variations are possible within the disclosed principles of the invention. All such modifications and variations are considered to be within the spirit and scope of the invention, as defined in the following claims.

I claim:

1. An object locator system comprising:

a transmitter unit having a casing housing a transmitter circuit therein for outputting a plurality of RF signals, a first pushbutton operable externally of the casing and coupled to the transmitter circuit for selecting one of the RF signals, and a second pushbutton operable externally of the casing and coupled to the transmitter circuit for sending the selected RF signal; and a receiver unit having a casing provided with attachment means for allowing it to be attached to an object, said casing housing a receiver circuit for receiving the plurality of RF signals transmitted by the transmitter unit and outputting an activation signal, and a light illumination element that is illuminated in response to the activation signal.

2. An object locator system according to claim 1, wherein said transmitter circuit transmits the RF signal only when the second pushbutton is pressed and said receiver circuit is operative to output said activation signal only for so long as the RF signal is received from the transmitter unit.

3. An object locator system according to claim 1, wherein said transmitter circuit includes a digital integrated circuit for setting the transmitter circuit to send a unique coded signal, and the receiver circuit includes a digital integrated circuit for setting the receiver circuit to detect the unique coded signal, whereby the receiver unit only responds to the transmitter unit sending the unique coded signal.

4. An object locator system according to claim 1, wherein said receiver unit further comprises a sound generator circuit and a sound speaker for generating a sound output in response to the activation signal.

5. An object locator system according to claim 4, wherein the sound output may be selected by a user depressing the first pushbutton on the transmitter unit.

6. An object locator system according to claim 5, wherein said sound generator circuit is operable to generate sound only for so long as the RF signal sent by the transmitter unit is received by the receiver unit.

7. An object locator system according to claim 1, wherein the transmitter unit and the receiver unit each further comprise a slide switch having an on position, an off position and a protection mode position.

8. An object locator system according to claim 7, wherein, in the protection mode position, the transmitter circut transmits the RF signal continuously when the second pushbutton is pressed and released, and said receiver circuit is operative to output said activation signal only when the RF signal is not received from the transmitter unit, thereby notifying a user when the object is more than a certain distance away from the transmitter unit.

9. An object locator system comprising:

a transmitter unit having a casing housing a transmitter circuit therein for outputting a plurality of RF signals, a first pushbutton operable externally of the casing and coupled to the transmitter circuit for selecting one of the RF signals, and a second pushbutton operable externally of the casing and coupled to the transmitter circuit for sending the selected RF signal; and a receiver unit having a casing provided with attachment means for allowing it to be attached to an object, said casing housing a receiver circuit for receiving the plurality of RF signals transmitted by the transmitter unit and outputting an activation signal, said casing further housing a sound generator circuit and a sound speaker for generating a sound output in response to the activation signal.

10. An object locator system according to claim 9, wherein said sound generator circuit is operable to generate sound only for so long as the RF signal sent by the transmitter unit is received by the receiver unit.

11. An object locator system according to claim 9, wherein the sound output may be selected by a user depressing the first pushbutton on the transmitter unit.

12. An object locator system according to claim 9, wherein said transmitter circuit transmits the RF signal only when the second pushbutton is pressed and said receiver circuit is operative to output said activation signal only for so long as the RF signal is received from the transmitter unit.

13. An object locator system according to claim 9, wherein said transmitter circuit includes a digital integrated circuit for setting the transmitter circuit to send a unique coded signal, and the receiver circuit includes a digital integrated circuit for setting the receiver circuit to detect the unique coded signal, whereby the receiver unit only responds to the transmitter unit sending the unique coded signal.

14. An object locator system according to claim 9, wherein said receiver unit further comprises a light illumination element that is illuminated in response to the activation signal.

15. An object locator system according to claim 9, wherein the transmitter unit and the receiver unit each further comprise a slide switch having an on position, an off position and a protection mode position.

16. An object locator system according to claim 15, wherein, in the protection mode position, the transmitter circut transmits the RF signal continuously when the second pushbutton is pressed and released, and said receiver circuit is operative to output said activation signal only when the RF signal is not received from the transmitter unit, thereby notifying a user when the object is more than a certain distance away from the transmitter unit.

17. A piece of luggage having four side enclosing panels and a locator system, said system comprising a receiver unit having a casing provided with attachment means for allowing it to be incorporated directly into one of the side enclosing panels, said casing housing a receiver circuit for receiving an RF signal transmitted by a transmitter unit and outputting an activation signal, a sound generator circuit and a sound speaker for generating a sound output in response to the activation signal.

18. A piece of luggage according to claim 17, wherein said sound generator circuit is operative to generate sound only for so long as the RF signal sent by the transmitter unit is received by the receiver unit.

19. A piece of luggage according to claim 17, wherein the transmitter unit outputs a plurality of RF signals and comprises a first pushbutton coupled to the transmitter circuit for selecting one of the RF signals, and a second pushbutton coupled to the transmitter circuit for sending a selected RF signal, wherein the sound output may be selected by a user depressing the first pushbutton on the transmitter unit.

20. A piece of luggage according to claim 19, wherein said transmitter circuit transmits the selected RF signal only when the second pushbutton is pressed and said receiver circuit is operative to output said activation signal only for so long as the RF signal is received from the transmitter unit.

21. A piece of luggage according to claim 17, wherein said transmitter circuit includes a digital integrated circuit for setting the transmitter circuit to send a unique coded signal, and the receiver circuit includes a digital integrated circuit for setting the receiver circuit to detect the unique coded signal, whereby the receiver unit only responds to the transmitter unit sending the unique coded signal.

22. A piece of luggage according to claim 17, wherein said receiver unit further comprises a light illumination element that is illuminated in response to the activation signal.

* * * * *